US011613856B2

(12) United States Patent
Doy et al.

(10) Patent No.: US 11,613,856 B2
(45) Date of Patent: Mar. 28, 2023

(54) MACHINE, SYSTEM, AND METHOD FOR WORK CYCLE AUTOMATION

(71) Applicant: Caterpillar Paving Products Inc., Brooklyn Park, MN (US)

(72) Inventors: Nathaniel Doy, Maple Grove, MN (US); Lee M. Hogan, Champlin, MN (US); Jason W. Muir, Andover, MN (US); Hyppolite Kuissi, Peoria, IL (US); Timothy Michael O'Donnell, Long Lake, MN (US); Matthew-David S. Frantz, Eden Praire, MN (US); Jacob M. Saari, Elk River, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 208 days.

(21) Appl. No.: 16/848,626

(22) Filed: Apr. 14, 2020

(65) Prior Publication Data

US 2021/0317621 A1 Oct. 14, 2021

(51) Int. Cl.
*E01C 23/088* (2006.01)
*E01C 23/12* (2006.01)

(52) U.S. Cl.
CPC ..... *E01C 23/127* (2013.01); *E01C 23/088* (2013.01)

(58) Field of Classification Search
CPC ..... E01C 23/127; E01C 23/088; E01C 23/065
See application file for complete search history.

(56) References Cited

U.S. PATENT DOCUMENTS

| | | | | |
|---|---|---|---|---|
| 7,942,604 | B2 | 5/2011 | Willis et al. | |
| 8,851,792 | B1 | 10/2014 | Schlenker et al. | |
| 8,899,689 | B2 | 12/2014 | Killion | |
| 9,507,348 | B2 | 11/2016 | Payne et al. | |
| 9,797,100 | B1 | 10/2017 | Muir et al. | |
| 2015/0115689 | A1* | 4/2015 | Snoeck | E01C 23/085 299/1.5 |
| 2016/0326701 | A1 | 11/2016 | Schlenker et al. | |
| 2020/0173139 | A1 | 6/2020 | Gentle et al. | |
| 2022/0186463 | A1 | 6/2022 | Gentle et al. | |

FOREIGN PATENT DOCUMENTS

EP 2 977 514 B1 7/2017

OTHER PUBLICATIONS

U.S. Appl. No. 17/363,632, filed Jun. 30, 2021, Inventor(s) Michael C. Gentle, et al., (not yet published).

* cited by examiner

*Primary Examiner* — Sunil Singh
(74) *Attorney, Agent, or Firm* — Xsensus LLC

(57) ABSTRACT

A milling machine, system, and method for implementing a return to cut operation and/or an exit cut operation controls legs of the milling machine, a rotor of the milling machine, and front and rear doors of a mixing chamber of the milling machine according to settings for each of the return to cut operation and the exit cut operation. Such control can be based on signals from one or more sensors of the milling machine configured to sense various position-related characteristics of the milling machine, and can be performed responsive to a control input at an operator control interface of the milling machine.

18 Claims, 7 Drawing Sheets

MACHINE, SYSTEM, AND METHOD FOR WORK CYCLE AUTOMATION

TECHNICAL FIELD

The present disclosure relates to automation for a working machine, and more particularly to automation of a return to cut operation and/or an exit cut operation of a milling machine.

BACKGROUND

Conventionally, an operator of a milling machine, such as a rotary mixer or a cold planer, may perform repetitive tasks with each pass. Such repetitive tasks can largely occur in the setup phase (i.e., return to cut or milling operation) and the completion phase (i.e., exit cut or milling operation). Depending upon operator-related conditions, such as experience, fatigue, or forgetfulness, some tasks may be inadvertently omitted from the setup or completion phases.

U.S. Pat. No. 9,797,100 ("the '100 patent") describes a milling machine configured to operate in a travel mode and a work mode. According to the '100 patent, when the travel mode is actuated the rotor is raised to a predetermined position, front and rear doors of a mixing chamber are closed, and the frame is raised to a predetermined height. The '100 patent also describes that in the work mode the frame is lowered to a predetermined height, the rotor is lowered to a predetermined position, and the front and rear doors of the mixing chamber are opened to predetermined positions.

SUMMARY OF THE DISCLOSURE

In one aspect, the present disclosure describes a method. The method, which can be implemented in a milling machine such as a rotary mixer, can comprise: responsive to an operator control input, automatically lowering, under control of a controller, a frame of the rotary mixer to a cutting height; responsive to the operator control input, automatically lowering, using the controller, a rotor of the rotary mixer to a rotor cutting height independent of the lowering of the frame; and responsive to the operator control input, automatically moving a rear door of a mixing chamber of the rotary mixer to a rear door cutting position, where the rear door is at least partially open and in a locked state or a floating state in the rear door cutting position. In the locked state the rear door can be open by an amount set in advance, and in the floating state the rear door can provide a down pressure set in advance.

In another aspect, the present disclosure implements or provides a milling machine. The milling machine can comprise an operator control interface; a frame; a milling chamber having a front door, a rear door opposite the front door, and a pair of opposing side plates between the front door and the rear door; a rotor provided at least partially in the milling chamber; a plurality of sensors provided about the frame; and a controller configured to control a plurality of legs of the milling machine, the rotor, the front door, and the rear door according to settings stored in memory accessible by the controller for each of an automated return to cut operation and an automated exit cut operation. For the automated return to cut operation the controller can control the plurality of legs of the milling machine, the rotor, the front door, and the rear door according to a first plurality of settings to return to first previously set operator settings corresponding to an immediately previous cutting operation to perform a next cutting operation. For the automated exit cut operation the controller can control the plurality of legs of the milling machine, the rotor, the front door, and the rear door according to a second plurality of settings to exit a current cutting operation according to second previously set operator settings. The controller can be configured to control each of the automated return to cut operation and the automated exit cut operation responsive to respective single control inputs at the operator control interface and based on signals from the plurality of sensors.

In yet another aspect a non-transitory computer-readable storage medium storing computer-readable instructions that, when executed by a computer, cause the computer to perform a method can be provided or implemented. The method can comprise controlling raising a rotor of a milling machine toward a stowed or travel position as part of an exit cut operation; and as the rotor is being raised toward the stowed or travel position, controlling configuration of respective states of a front door and a rear door of a mixing chamber of the milling machine, based on direction of travel of the milling machine, to fill in a material void associated with said raising the rotor, as part of the exit cut operation. When the milling machine is moving forward the front door can be controlled to be open and the rear door is set to a floating state, and when the milling machine is moving backward the rear door can be controlled to be open and the front door is set to the floating state. In the floating state the rear door or the front door can provide a down pressure set in advance.

Other features and aspects of this disclosure will be apparent from the following description and the accompanying drawings.

DETAILED DESCRIPTION

The present disclosure relates to automation for a milling machine, and more particularly to automation of a return to cut operation and/or an exit cut operation thereof.

Figure 1:
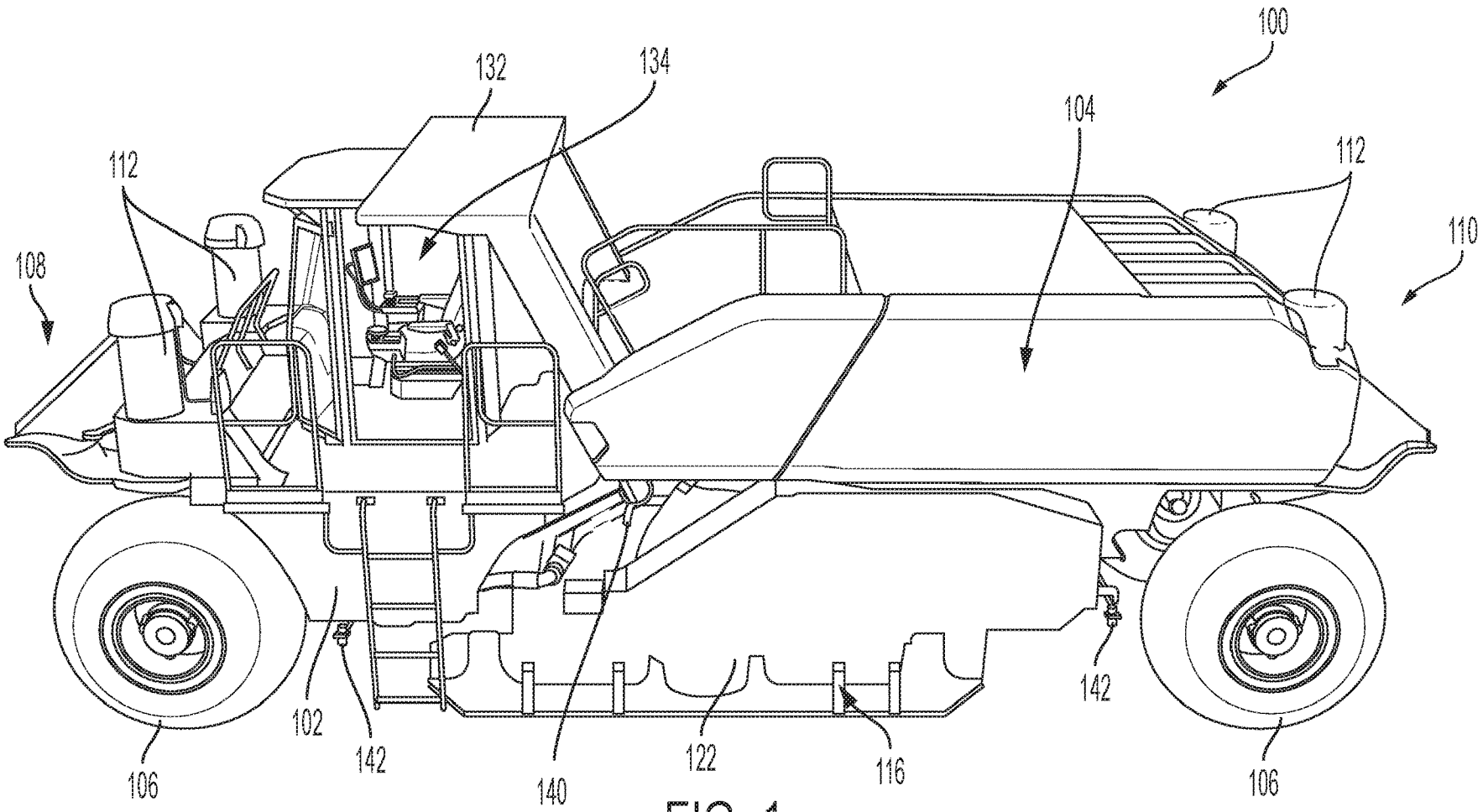
FIG. 1 is a side perspective view of a milling machine according to one or more embodiments of the disclosed subject matter.

Referring now to the drawings, FIG. 1 is a side perspective view of a milling machine 100 according to one or more embodiments of the disclosed subject matter. The milling machine 100 of FIG. 1 is a rotary mixer. Generally, rotary mixers can be used to pulverize a ground surface, such as roadways based on asphalt, and mix a resulting pulverized layer with an underlying base, to stabilize the ground surface. Rotary mixers may also be used as a soil stabilizer to cut, mix, pulverize, and stabilize a soil surface, for instance, to attain a strengthened soil base. Optionally, rotary mixers may add asphalt emulsions or other binding agents during pulverization to create a reclaimed surface. Though the milling machine 100 is shown as a rotary mixer, other machines for road reclamation, soil stabilization, surface pulverization, or other applications may be implemented according to embodiments of the disclosed subject matter, such as cold planers.

The milling machine 100 can include a frame 102, an engine 104 supported on the frame 102, and one or more ground engaging units or traction devices 106. The traction devices 106 can be operatively coupled to the engine 104 by a transmission mechanism (not shown) to drive the traction devices 106 and propel the milling machine 100. Although, the traction devices 106 are shown as wheels (with tires), the traction devices 106 may alternatively be tracks, or a combination of both tracks and wheels, according to embodiments of the disclosed subject matter.

The frame 102 can include a front portion 108 and a rear portion 110, where lifting columns 112 can be provided at the front portion 108 and the rear portion 110, such as shown in FIG. 1. Generally, the lifting columns 112, which may also be referred to herein as legs 112 of the milling machine 100, can couple the traction devices 106 to the frame 102.

The legs 112 can be controlled to allow adjustment of a height, a grade, and/or a slope of the frame 102 relative to a ground surface, for instance. That is, the legs 112 can be moved up or down, independently or together (e.g., in pairs or all together), by way of respective actuators, to adjust the height, the grade, and/or the slope of the frame 102. Accordingly, the frame 102 can be adjusted relative to the ground surface. In an embodiment, the legs 112 may be actuated hydraulically. Optionally, each leg 112 can include a sensor to sense or detect height thereof (and hence associated height of the corresponding portion of the frame 102). For instance, each leg 112 can include an in-cylinder position sensor to sense or detect height-related positioning of the leg 112.

The milling machine 100 can also be comprised of a milling or mixing chamber 116. Optionally, the mixing chamber 116 may be considered part of the frame 102, since the mixing chamber 116 and the frame 102 can be adjusted together based on the up/down movement of the legs 112. The mixing chamber 116 can be located proximate to or at a center portion of the milling machine 100, such as shown in FIG. 1.

Figure 2:
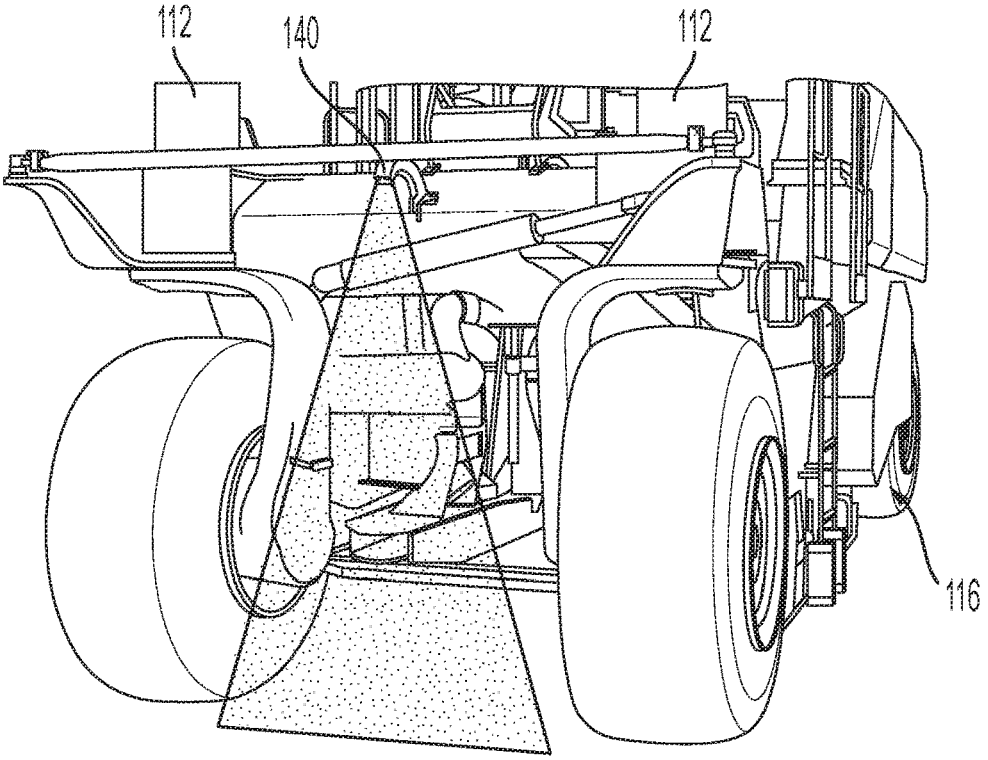
FIG. 2 is a front view of a portion of the milling machine of FIG. 1.
Figure 3:
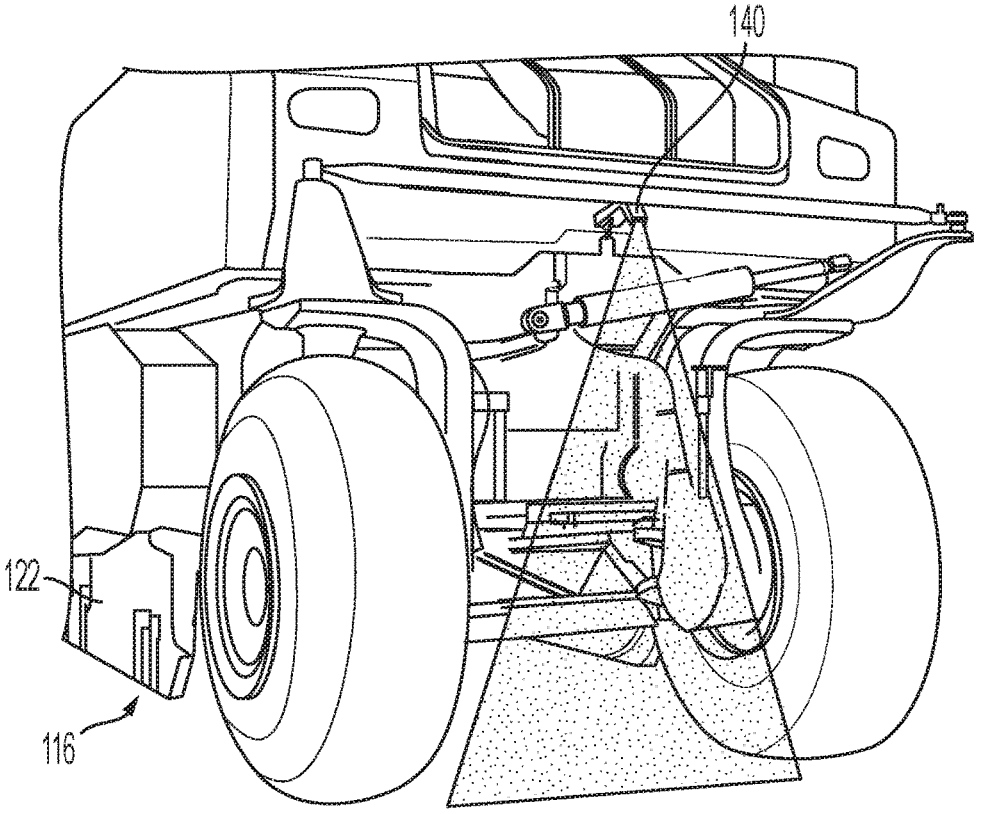
FIG. 3 is a rear view of a portion of the milling machine of FIG. 1.
Figure 4:
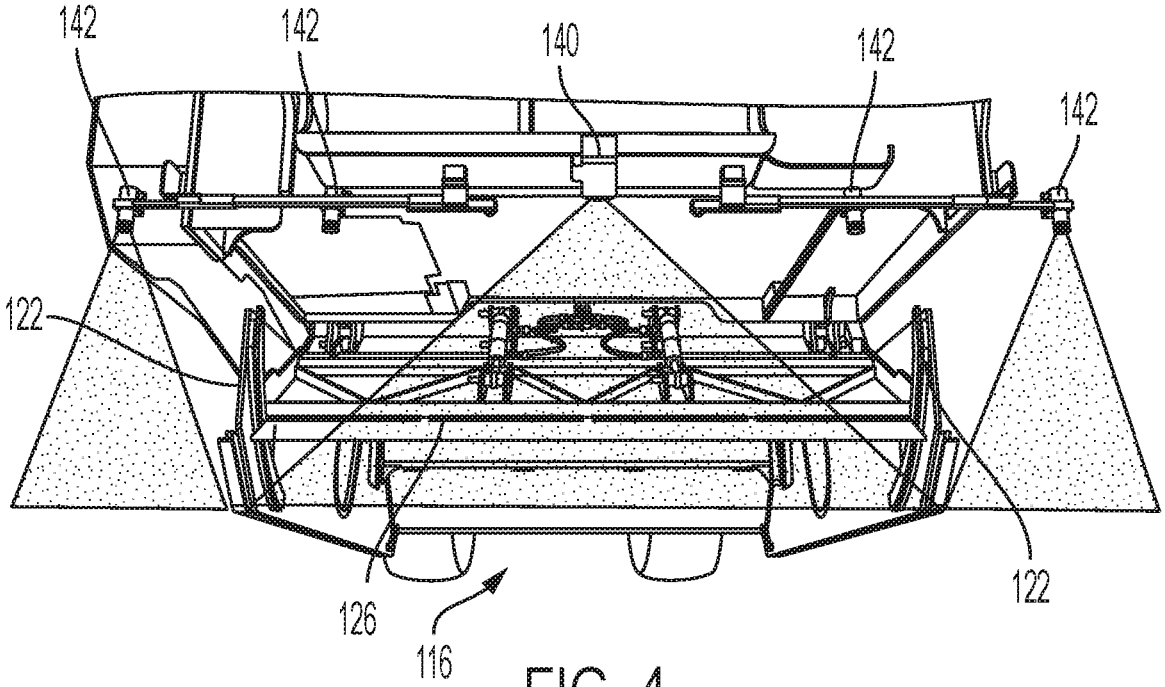
FIG. 4 is a rear view of a mixing chamber of the milling machine of FIG. 1.

As shown in FIGS. 1-7, the mixing chamber 116 can have a pair of opposing side plates 122, a front door 124 (in FIG. 5), and a rear door 126 (in FIG. 4). During a working operation (e.g., cutting, milling, mixing, etc.) the milling machine 100 can processes material and the side plates 122 may expand and contract and may be viewed as flowing on and within the material. A rotor 118 can be provided in the mixing chamber 116, either partially or fully depending upon a mode or operation of the milling machine 100.

Figure 7:
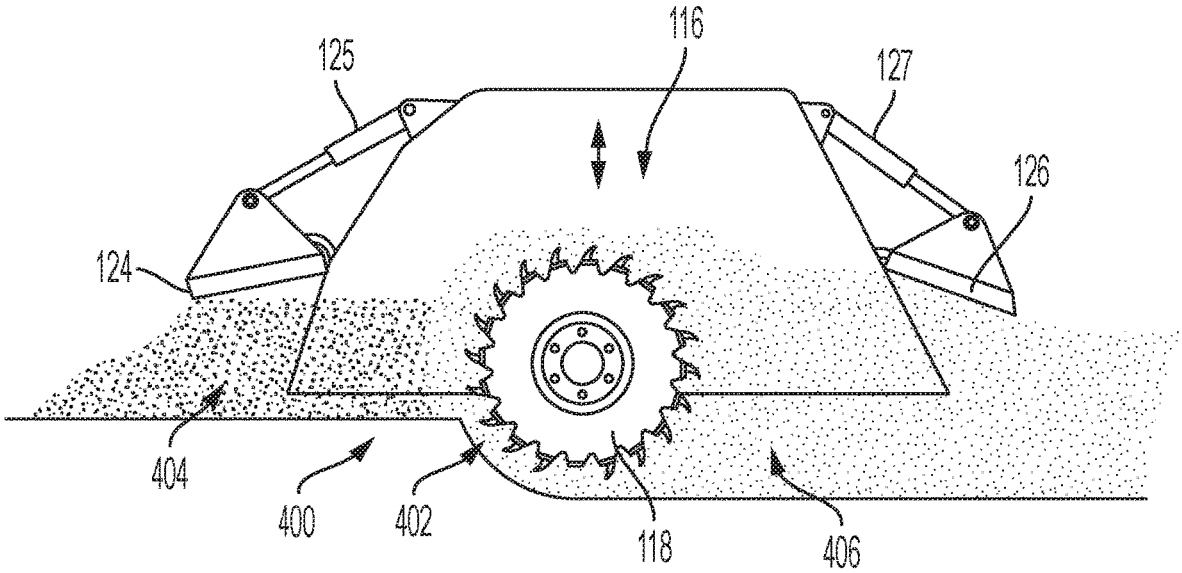
FIG. 7 shows an example of the mixing chamber of FIG. 6 in a second state of operation of the milling machine according to one or more embodiments of the disclosed subject matter.

The rotor 118 can be controlled to rotate so as to break and pulverize a surface layer 400 of the ground surface, such as diagrammatically shown in FIG. 7. Optionally, feed material 404 can be provided for mixing with the pulverized surface layer 400. The rotor 118 may also be moved vertically (i.e., up and down) within the mixing chamber 116, via one or more actuators (not expressly shown), between a fully extended position and a fully retracted position. The rotor 118 can be moved vertically independent of the movement of the legs 112. That is, according to embodiments of the disclosed subject matter, the rotor 118 can be controlled to move vertically without moving any, all, or some of the legs 112, some or all of the legs 112 can be controlled to move without vertical movement of the rotor 118, or the rotor 118 can be controlled to move vertically at the same time as movement of some or all of the legs 112.

Figure 6:
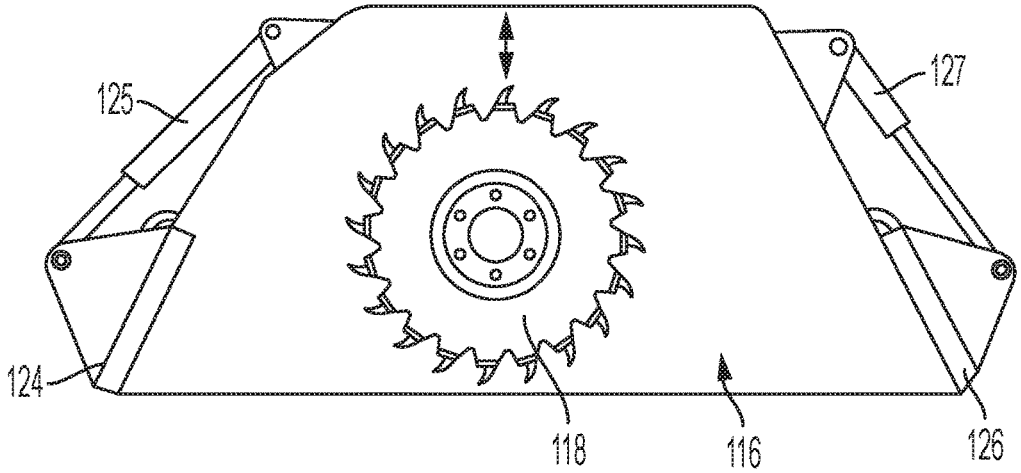
FIG. 6 shows an example of a mixing chamber of a milling machine in a first state of operation of the milling machine according to one or more embodiments of the disclosed subject matter.

FIG. 6 may be representative of the rotor 118 in the fully retracted position, and FIG. 7 may be representative of the rotor 118 in the fully extended position. Optionally, the fully retracted position may be called or characterized as a travel or stow position, and the fully extended position may be called or characterized as a working position (or cutting, or mixing, or milling position). Thus, FIG. 7 may also be representative of the rotor 118 in a cutting position, though the cutting position is not necessarily always at the fully extended position. In the cutting position the rotor 118 can extend below the surface layer 400 to cut the surface layer 400 according to a predetermined cutting depth. As noted above, the rotor 118 may also mix feed material 404 with the pulverized surface layer 400. In any case, with or without the feed material 404, operation of the rotor 118 can produce a resultant material 406.

A sensor may be provided in association with the rotor 118 or a portion thereof (e.g., each of one or more actuators thereof) to determine vertical positioning or height of the rotor 118. Such vertical positioning or height of the rotor 118 may be relative to a characteristic of the milling machine 100, such as an amount by which the rotor 118 projects from the bottom of the mixing chamber 116. Such vertical positioning or height of the rotor 118 may also be relative to the ground surface, for instance, the surface layer 400 of the ground surface.

The front door 124 can be located at a front end of the mixing chamber 116, and the rear door 126 can be positioned at a rear end of the mixing chamber 116. An actuator 125 can be operatively coupled to the first door 124 to open and close the front door 124. The actuator 125 can be controlled to set the front door 124 in a locked state or a floating state. Likewise, an actuator 127 can be operatively coupled to the rear door 126 to open and close the rear door 126. The actuator 127 can be controlled to set the rear door 126 in a locked state or a floating state.

The front door 124, when open, can allow entry of feed material 404 into the mixing chamber 116 (in a case that the milling machine 100 is moving forward). Positioning of the front door 124 can affect a degree of pulverization and/or mixing by regulating an amount, direction, and speed of a material flow of the feed material 404 into the mixing chamber 116. The rear door 126, whether open in the locked state or the floating state (also in the case that the milling machine 100 is moving forward), can allow exit of pulverized and/or mixed resultant material 406 to form a pulverized surface. The positioning of the rear door 126 can affect the degree of pulverization and/or compactness by regulating the amount and direction of the material flow through the mixing chamber 116.

An operator control station 132 can also be supported on the frame 102. The operator control station 132 can include a variety of components and controls to operate the milling machine 100, generally referred to in FIG. 1 as an operator control interface 134. The operator control interface 134 can include a steering system (e.g., a steering wheel, joystick, lever, etc.), a transmission control system, a speed control system for the milling machine 100, one or more displays, and a milling control interface. The milling control interface can have one or more of an operator control button, a toggle switch, a touch panel (e.g., of the one or more displays), a rotary switch, a radial dial, a switch, etc.

The operator control interface 134 can receive inputs from an operator of the milling machine 100 to control various operations of the milling machine 100. Such operations can include controlling a speed of the milling machine 100, a direction of the milling machine 100 (i.e., forward or backward), and milling-related operations, such as a return to cut operation, a cutting operation, and/or an exit cut operation.

The operator control interface 134, for instance, the milling control interface thereof, can also be used to receive settings from the operator for the milling-related operations such as those discussed above. For instance, the operator control interface 134 can receive inputs to control or set engine speed, rotor speed, frame height (via legs 112), rotor height of the rotor 118 (via vertical movement of the rotor 118 and/or movement of the legs 112), front door 124 positioning and/or state, rear door 126 positioning and/or state, rotor raise or lower speed of the rotor 118, raise or lower speed of the frame 102, etc., as non-limiting examples of settings for milling-related operations.

The operator control interface 134 can also receive an input from the operator to capture and save (discussed in more detail below) current settings for a milling-related operation, such as current cutting settings, for later retrieval so the milling machine 100 can be set to the same settings as before or perform an operation in the same way as before. Optionally, the operator control interface 134 can receive a single input from the operator to capture and save the current settings. Such settings, optionally, may be provided (e.g., displayed) to the operator and selectable, via the operator control interface 134, as a list of "favorites" in association with particular milling-related operations.

As shown in FIGS. 1-5, the milling machine 100 can also include a plurality of sensors (though one or more embodiments may include only one, some, or more than the sensors shown). One or more of the sensors can be in the form of image sensors (e.g., cameras) 140. Additionally or alternatively, one or more sensors can be in the form of sonic sensors 142. The milling machine 100 of FIGS. 1-5, for instance, shows a combination of multiple image sensors 140 and multiple sonic sensors 142. Optionally, sensors in the form of lasers can be provided or substituted, for instance, for some or all of the sonic sensors 142.

Figure 5:
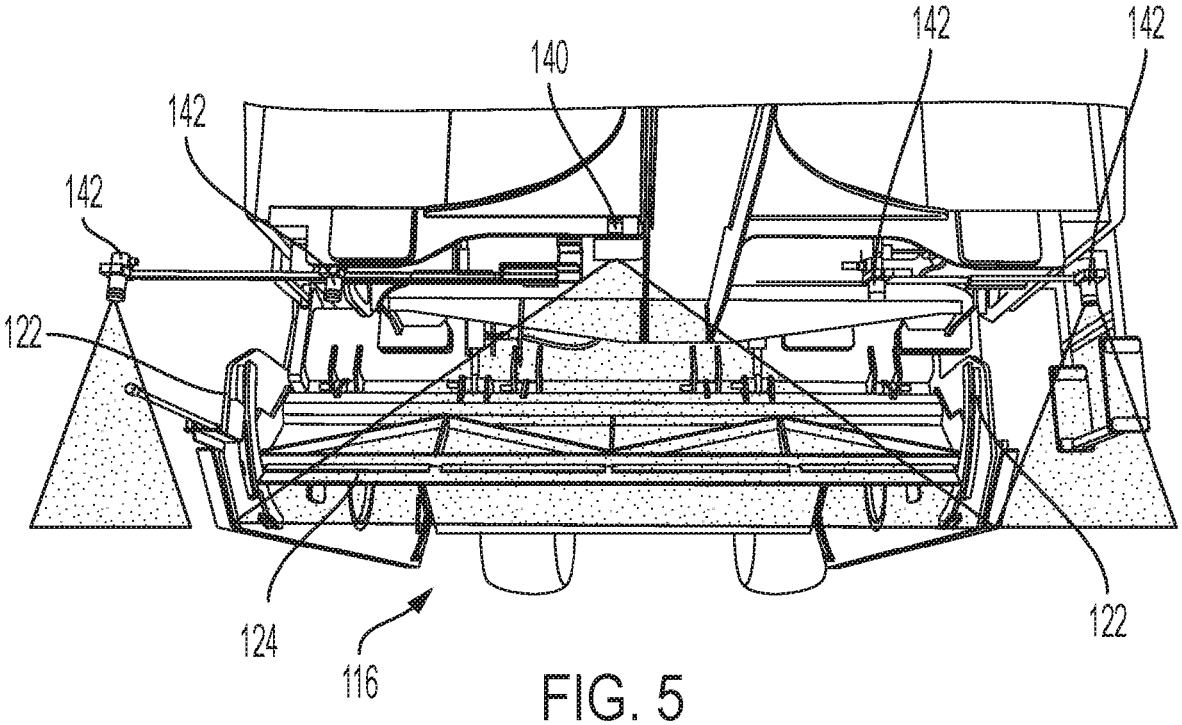
FIG. 5 is a front view of the mixing chamber of the milling machine of FIG. 1.

As a non-limiting example, the milling machine 100 can have, at one or more sides thereof, a side image sensor 140, such as shown in FIG. 1; a front image sensor 140, such as shown in FIG. 2; a rear image sensor 140, such as shown in FIG. 3; an image sensor 140 provided at a rear side of the mixing chamber 116, such as shown in FIG. 4; and an image sensor 140 provided at the front side of the mixing chamber 116, such as shown in FIG. 5. Each of the image sensors 140 can be configured to capture images, for instance, images corresponding to the ground surface (e.g., a top surface thereof) and/or images corresponding to portions of the milling machine 100. The images can be processed to determine various heights of the milling machine 100, such as height of the frame 102, height of the mixing chamber 116, state or position of the front door 124 and/or the rear door 126, and/or height of the rotor 118, relative to the ground surface or other portions of the milling machine 100 (e.g., bottom of mixing chamber 116 relative to height of rotor 118). Such determinations can be used to control various components of the milling machine 100, such those discussed above, according to selected settings for the milling machine 100.

For instance, the side image sensor 140 of FIG. 1 can capture images of the bottom of the side plate 122 and the ground surface, where such images can be processed (discussed in more detail below) to determine height of the bottom of the mixing chamber 116 relative to the ground surface. The side image sensor 140 may alternatively be provided on the other side of the milling machine 100, or side image sensors 140 may be provided on each side of the milling machine 100. As noted above, the mixing chamber 116 may be considered part of the frame 102. Hence, the distance from the bottom of the side plate 122 to the ground surface may be characterized as a height of the frame 102. Such data may be used without the need to provide position sensors in the legs 112 or without having to process data from position sensors in the legs 112 in combination with the data from the sonic sensors 142 to determine height-related information for various portions of the frame 102.

As another example, the image sensors 140 respectively provided at the front and rear sides of the mixing chamber 116 can capture images of the front door 124 and the rear door 126, where such images can be processed to determine and/or control states of the front door 124 and the rear door 126. Such image sensors 140 may also capture images of inside the mixing chamber 116 (depending upon the state and configuration of the front door 124 and the rear door 126). Such images can be processed to determine the distance of the bottom of the mixing chamber 116 and/or the rotor 118 relative to the ground surface and characteristics of the ground surface, such as the surface layer 400 and/or the resultant material 406.

As yet another example, the front image sensor 140 and the rear image sensor 140 can capture images of the ground surface at the front portion 108 and the rear portion 110 of the frame 102, respectively, and optionally portions of the milling machine 100 at the front portion 108 and the rear portion 110. Such images can be processed to determine height (or heights) of the frame 102 relative to the ground surface.

The milling machine 100 can have, as a non-limiting example, a plurality of sonic sensors 142 at the rear side of the mixing chamber 116, such as shown in FIG. 4, and a plurality of sonic sensors 142 at the front side of the mixing chamber 116, such as shown in FIG. 5. More or less than the number of sonic sensors 142 shown in FIG. 4 and FIG. 5 can be implemented, however. Such sonic sensors 142, which can be provided on the frame 102, can sense distance to the ground surface. Hence, data from the sonic sensors 142 can be processed to determine a height of the frame 102 (or heights of different portions of the frame 102) relative to the ground surface. Such data may be used without the need to provide position sensors in the legs 112 or without having to process data from position sensors in the legs 112 in combination with the data from the sonic sensors 142 to determine height-related information for various portions of the frame 102.

Figure 8:
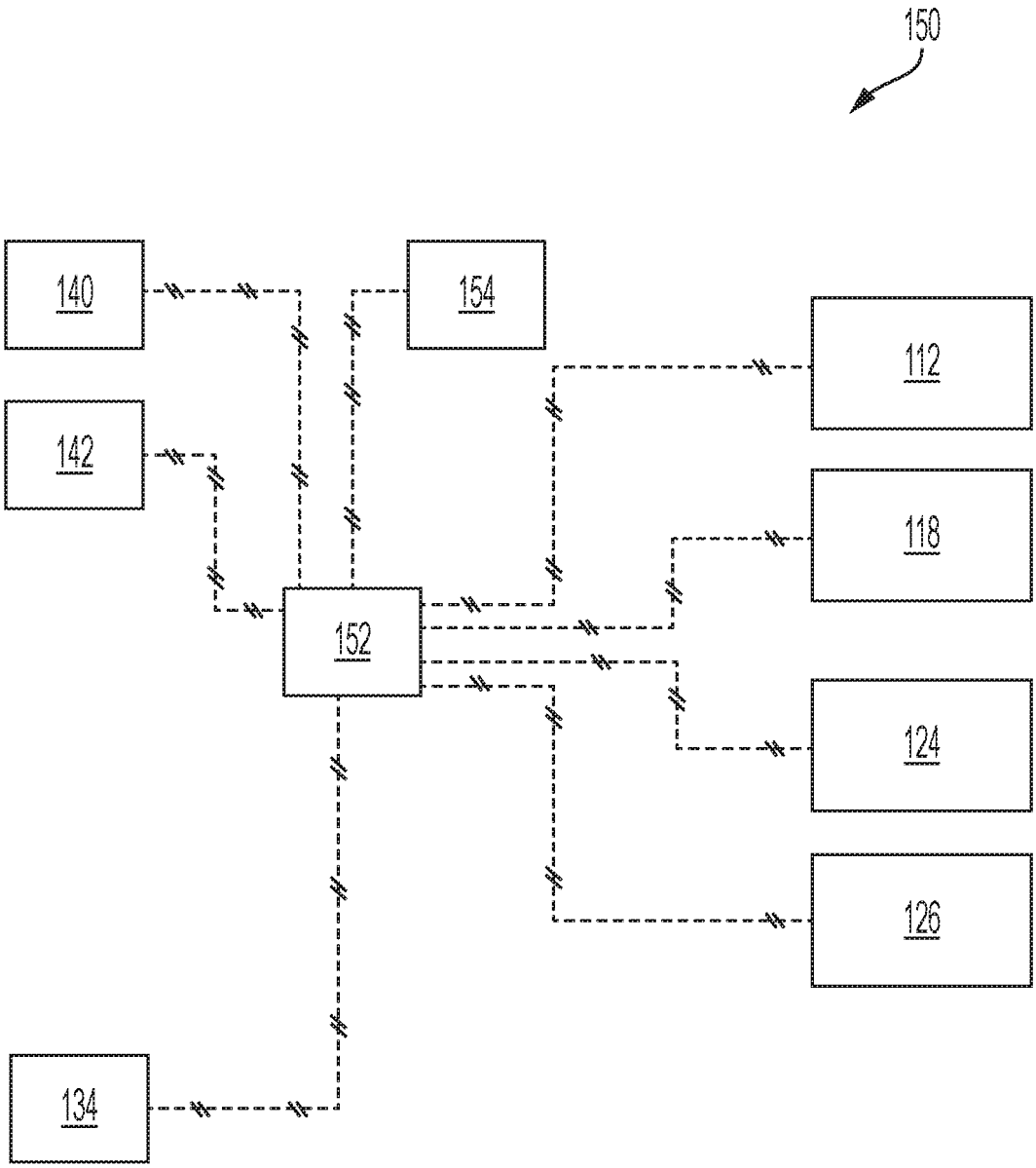
FIG. 8 illustrates a control system according to one or more embodiments of the disclosed subject matter.

FIG. 8 illustrates a control system 150 according to one or more embodiments of the disclosed subject matter. The control system 150 can be implemented on the milling machine 100 to control operation of the milling machine 100.

The control system 150 can include a controller or control circuitry 152, which may be or include a microprocessor or other processor or processing device configured to control a plurality of devices or systems of the milling machine 100. For example, in an embodiment the controller 152 may be an electronic control module (ECM) or multiple ECMs.

The controller 152 can be in communication with various components of the milling machine 100. For instance, FIG. 8 shows that the controller 152 can send control signals to control the legs 112, the rotor 118, the front door 124 of the mixing chamber 116, and the rear door 126 of the mixing chamber 116. Depending upon whether respective actuators of the foregoing components have their own position sensors or the like, the controller 152 can also receive signals representative of heights of the foregoing components from the components. Additionally or alternatively, the controller 152 can receive signals from the image sensor(s) 140 and/or the sonic sensor(s) 142. Such feedback from the image sensor(s) 140 and/or the sonic sensor(s) 142 can be used to control the legs 112, the rotor 118, the front door 124 of the mixing chamber 116, and the rear door 126 of the mixing chamber 116.

The controller 152 can also receive signals from the operator control interface 134. Such signals can correspond to operator control inputs to control the milling machine 100, to input settings for control of the milling machine 100, and to capture and record current settings of the milling machine 100 during milling-related operations, such as a cutting operation, a return to cut operation, and an exit cut operation.

For instance, the controller 152 can receive control signals from the operator control interface 134 in response to one or more operator control inputs to the operator control interface 134 to perform a return to cut operation or an exit cut operation. Optionally, each of the return to cut operation and the exit cut operation can be initiated and performed via a predetermined number of operator control inputs to the operator control interface 134. For instance, embodiments of the disclosed subject matter can implement a single operator control input to the operator control interface 134 (e.g., the operator only has to activate one button, lever, etc.) to perform either the return to cut operation or the exit cut operation. As another example, multiple operator control inputs (e.g., two) to the operator control interface 134 can be implemented for each of the return to cut operation and the exit cut operation, for instance, to initiate different phases of the particular operation.

Memory 154 may be provided, and may be accessed by the controller 152. Though memory 154 is shown in FIG. 8 as separate from the controller 152, according to one or more embodiments some or all of the memory 154 can be implemented within the controller 152. The memory 154 may include one or more storage devices configured to store information used by the controller 152 to perform operations to control the milling machine 100. For instance, memory 154 can store one or more operating programs for the controller 152. Thus, the memory 154, or portions thereof, may be characterized as a non-transitory computer-readable storage medium that stores computer-readable instructions which, when executed by a computer (e.g., a microprocessor of the controller 152), can cause the computer to control operations to control the milling machine 100, such as to perform the return to cut operation, the cutting operation, or the exit cut operation.

Optionally, the memory 154 can store settings for the milling machine 100. For instance, the memory 154 can store settings to configure components of the milling machine 100, such as the legs 112, the rotor 118, the front door 124, and/or the rear door 126, to perform particular operations, including the return to cut operation and/or the exit cut operation. Such settings may be entered (i.e., set) by the operator using the operator control interface 134, as noted above.

INDUSTRIAL APPLICABILITY

As noted above, the present disclosure relates to milling machine automation for various operations, including a return to cut operation and/or an exit cut operation of the milling machine.

According to embodiments of the disclosed subject matter, for a particular job, worksite, or operator preference, certain setting configurations for the milling machine 100 can be implemented automatically in response to one or more control inputs at the operator control interface 134. Moreover, such settings can be previously saved in memory 154 by the operator for later retrieval and implementation under the control of the controller 152 for a later (e.g., next or subsequent) same operation, such as the return to cut operation or the exit cut operation. Thus, for the later operation the milling machine 100 can be automatically configured, under control of the controller 152, without the operator having to enter in again (e.g., individually) the settings to revert the configuration of the milling machine 100 to prior settings. Optionally, embodiments of the disclosed subject matter can implement a save function, whereby the operator can operate the operator control interface 134 to capture and record current settings for a current milling-related operation, such as a return to cut operation, a cutting operation, or an exit cut operation. The operator can use the operator control interface 134 to retrieve the recorded settings to automatically set the settings of the milling machine 100 to the same settings as before when the operator wishes to perform the same corresponding milling-related operation in an effort to achieve the same or substantially similar results as the prior milling-related operation.

Figure 9:
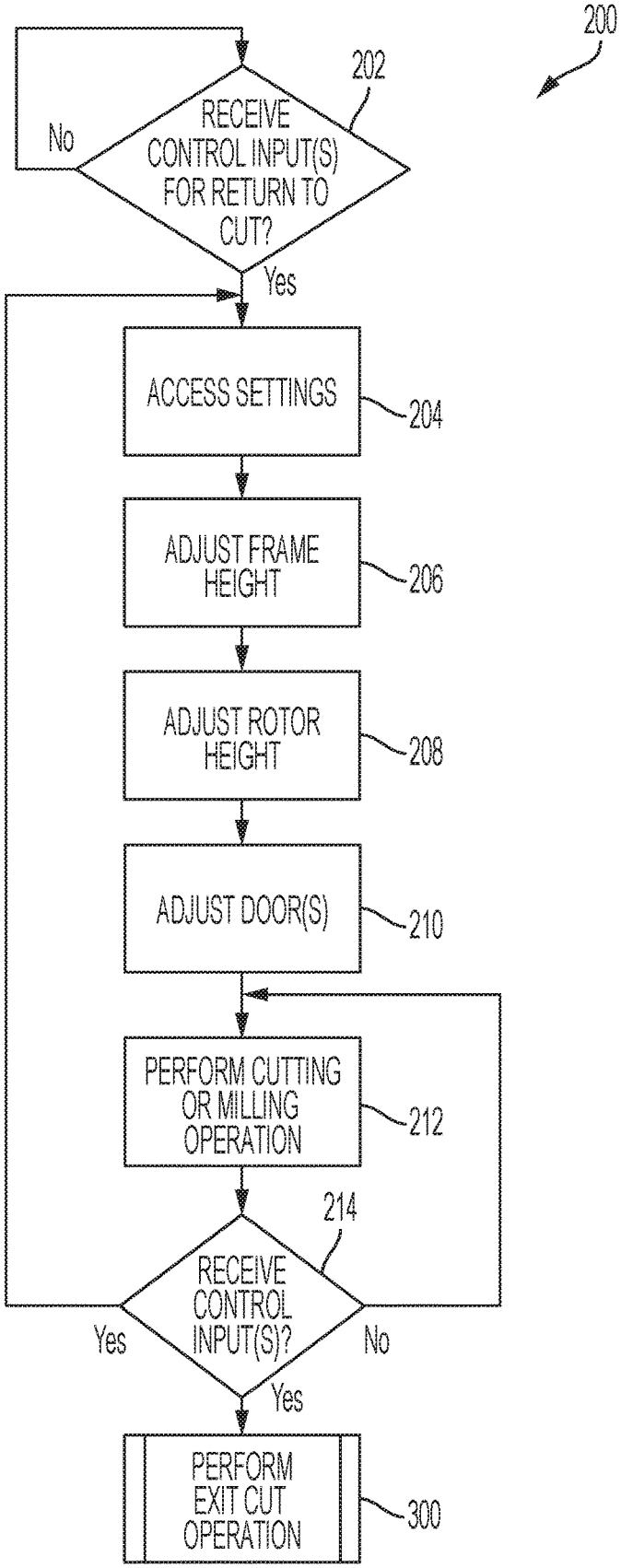
FIG. 9 is a flow chart of a method for a return to cut operation according to one or more embodiments of the disclosed subject matter.

FIG. 9 is a flow chart of a method 200 for a return to cut operation according to one or more embodiments of the disclosed subject matter. As noted above, the controller 152 can control the legs 112, the rotor 116, the front door 124, and the rear door 126 to perform the return to cut operation. Moreover, settings for the return to cut operation, which may have been previously input by the operator using the operator control interface 134 and saved in the memory 154, can be accessed by the controller 152 to control the return to cut operation. Feedback data from one or more sensors, such as one or more of image sensors 140 and/or one or more of sonic sensors 142, can be used to control the legs 112, the rotor 116, the front door 124, and the rear door 126 to achieve the settings for the return to cut operation.

At operation 202 the method 200 can involve determining whether a control input (or inputs) has been received to perform the return to cut operation. Such control input can be received at the operator control interface 134, and the controller 152 can monitor whether a control signal corresponding to the control input is received. The control input to initiate the return to cut operation at operation 202 can be received at the beginning of a cutting pass of the milling machine 100 to start the cutting pass. Additionally or alternatively, the control input to initiate the return to cut operation can be received during (e.g., in the middle of) the cutting pass of the milling machine 100.

If the control input to perform the return to cut operation is received, control can proceed to operation 204. At operation 204 the method 200 can access settings for the milling machine 100 to perform the return to cut operation. As noted above, such settings can be stored in the memory 154 and accessed by the controller 152. The settings may correspond to cutting settings for an immediately previous cutting operation of the milling machine 100, which may have been automatically captured and saved by the operator upon an input to the operator control interface 134. Optionally, the previous cutting operation may be part of the same cutting pass. Alternatively, the previous cutting operation can be from a previous cutting pass, where the settings for the previous cutting operation can be used for a next or subsequent cutting pass. To be clear, the settings may include results- or target-based settings, such as a particular cutting depth, and, consequently, settings for specific components of the milling machine 100 to achieve the particular results- or target-based setting(s).

At operation 206 the height of the frame 102 can be adjusted. For example, the height of the frame 102 can be lowered by controlling one or more of the legs 112, such as all of the legs 112. Such adjustment can be relative to the ground surface, and can be to a cutting height for the milling machine 100. The height adjustment of the legs 112 can also adjust the height of the mixing chamber 116, since the mixing chamber 116 may not be independently movable relative to the frame 102 and hence may be considered part of the frame 102. Such height adjustment of the legs 112 can also adjust (e.g., lower) the height of the rotor 118.

The height adjustment of the frame 102 can be based on signals from one or more of the image sensors 140 and/or one or more of the sonic sensors 142. For instance, data from the image sensor(s) 140 and/or the sonic sensor(s) 142 can be processed to determine height of the frame 102 (including portions thereof) relative to the ground surface and/or height of the mixing chamber 116 relative to the ground surface. The processing can also involve determining when the height of the frame 102 and/or the height of the mixing chamber 116 has reached the height(s) from operation 204. Optionally, position sensors of the legs 112 themselves may be used to adjust the height of the frame 102. Based on the feedback from the sensors the controller 152 can control the height adjustment of one or more of the legs 112 to achieve the desired setting (or settings). That is, when the controller 152 determines, based on the feedback from the sensors, that the height of the frame 102 has been adjusted to the desired setting, the controller 152 can stop adjusting the height of the frame 102 and maintain the height of the frame 102 at the desired setting.

According to one or more embodiments, the height of the frame 102, particularly the height of the mixing chamber 116, can be, according to the settings from the operation 204, set for a desired (e.g., optimal) height for the cutting operation. In general, a desired height for the mixing chamber 116 for the cutting operation may be the bottom of the mixing chamber 116, for instance, the bottom of the side plates 122, being above the top of the surface layer 400 and at or about at half the height of the resultant material 406. Such height of the bottom of the mixing chamber 116 can be set such that the bottom of the mixing chamber 116 on one hand does not end up digging into the surface layer 400 and on the other hand does not leave sufficient gapping below the mixing chamber 116 where an undesirable amount of material can escape the mixing chamber 116 (e.g., any or enough to make the mixing operation unsatisfactory).

At operation 208 the height of the rotor 118 can be adjusted. For example, the height of the rotor 118 can be lowered by controlling one or more actuator thereof (not expressly shown) operatively coupled to the rotor 118. Such adjustment can be relative to the ground surface, and can be according to a cutting height for the rotor 118 from operation 204, such as shown in FIG. 7. The cutting height for the rotor 118 can be to achieve a desired cutting depth in the surface layer 400 of the ground surface.

The height of the rotor 118 can be adjusted independent of the adjustment of the height of the frame 102. Additionally, though operation 208 is shown in FIG. 9 after operation 206, operation 208 can be performed prior to operation 206 or at the same time as operation 206.

The adjustment of the height of the rotor 118 can be based on signals from a position sensor associated with the rotor 118, such as a position sensor of the corresponding actuator (or position sensors of respective actuators). Optionally, the adjustment of the rotor 118 can be based on data from one or more of the image sensors 140 and/or one or more of the sonic sensors 142. For instance, according to one or more embodiments, the height of the rotor 118 can be adjusted based on the height setting for the frame 102 or the mixing chamber 116 via the legs 112. Based on the feedback from the sensors the controller 152 can control the height adjustment of the rotor 118 to achieve the desired setting (or settings). That is, when the controller 152 determines, based on the feedback from the sensors, that the height of the rotor 118 has been adjusted to the desired setting, the controller 152 can stop adjusting the height of the rotor 118 and maintain the height of the rotor 118 at the desired setting.

At operation 210 the front door 124 and/or the rear door 126 can be adjusted. For instance, each of the front door 124 and the rear door 126 can be controlled to a front door cutting position and a rear door cutting position, respectively, for a cutting operation of the milling machine 100. Such control can include opening the front door 124 and/or the rear door 126, for instance, from a closed position (e.g., fully closed). Each of the front door 124 and the rear door 126 can be at least partially open in the respective cutting positions. The amount at which the front door 124 and the rear door 126 are open can be the same or different. Optionally, the positioning of the front door 124 and/or the rear door 126 can be set in combination with the height of the mixing chamber 116 and/or the height of the rotor 118, for instance, for a particular cutting operation (e.g., optimum cutting height). Though operation 210 is shown in FIG. 9 after operation 208, operation 210 can be performed prior to operation 206, prior to operation 208, or at the same time as one or more of operation 206 or operation 208.

Operation 210 can also include setting the front door 124 to a locked state whereby the front door 124 is set and does not open or close during the cutting operation. Optionally, the front door 124 may be prevented from being set to a floating state, particularly where the milling machine 100 is moving forward during the cutting operation. The amount by which the front door 124 is open can be to allow for a predetermined amount of feed material 404 to enter the mixing chamber 116.

Operation 210 can also include setting the rear door 126 to the locked state or the floating state. In the floating state the rear door 126 can provide a down pressure on the resultant material 406. The amount of down pressure can be according to the settings of operation 204.

An amount of gradation may be determined based on how long resultant material 406 is retained in the mixing chamber 116, where increased gradation may correspond to keeping the resultant material 406 in the mixing chamber 116 for a relatively longer amount of time and decreased gradation may correspond to keeping the resultant material 406 in the mixing chamber 116 for a relatively shorter amount of time.

Thus, an amount by which the rear door 126 is open, either in the locked state or the floating state, can determine the amount of gradation of the resultant material 406. The amount of down pressure provided by the rear door 126 (via control of the actuator 127, for instance, and/or supplemental hydraulics) can also control the amount by which the rear door 126 is allowed to open. In the floating state the rear door 126 can be controlled to float down on top of the resultant material 406 and, depending upon the set amount of down pressure and hence the "heaviness" of the floating rear door 126, can be set to a maximum value that the resultant material 406 lets the rear door 126 float to keep the resultant material 406 in the mixing changer 116 to achieve a desired result. As a non-limiting example, for 50% of down pressure for the rear door 126 in the floating state and a relatively deep cutting depth the rear door 126 may float to 100% open, whereas for a relatively shallow cutting depth the rear door 126 may float to only 15-20% open.

The adjustment of the front door 124 and/or the rear door 126 can be based on signals from one or more of the image sensors 140 and/or one or more of the sonic sensors 142. For instance, data from the image sensor(s) 140 and/or the sonic sensor(s) 142, particularly those at the front and rear of the mixing chamber 116, can be processed by the controller 152 to determine positioning of the front door 124 and/or the rear door 126 (e.g., open, closed, amount open, moving, distance from ground surface, etc.). The processing can also involve determining when the front door 124 and/or the rear door 126 have reached the desired state according to the settings of operation 204 and based on feedback from the sensors.

Upon determination that all of the settings for the return to cut operation have been achieved, either based on timing and/or data from various sensors, such as the image sensor(s) 140 and/or the sonic sensor(s) 142 as discussed above, at operation 212 the milling machine 100 can perform a cutting operation according to the settings of operation 204. Optionally, various settings of the cutting operation can be changed during the cutting operation, based on changing cutting conditions, such as changes in the condition of the ground surface (e.g., hard or wet) or a desired cutting operation outcome. The operator may choose to save the updated settings for the cutting operation by providing input to the operator control interface 134.

The cutting operation can continue until another control input is received. At operation 214 the method 200 can involve determining whether a control input to perform another return to cut operation is received or a control input to perform another operation, such as an exit cut operation is received. Such control input can be received at the operator control interface 134, and the controller 152 can monitor whether a control signal corresponding to the control input to perform another operation is received.

If the former, control can proceed to operation 204 or even operation 206 if, for instance, the settings are already available to the controller 152 without the need to access the memory 154. As an example, the operator may choose to initiate another return to cut operation during a same cutting pass to "rezero" or otherwise return the milling machine 100 to desired settings to achieve a desired outcome if during the cutting operation the milling machine 100 deviates from the settings of the previous return to cut operation due to a change in milling-related conditions, such as the condition of the surface layer 400 (e.g., gets harder or softer). If the latter, control can proceed to operation 300 to perform the exit cut operation, which is discussed in more detail with respect to FIG. 10.

Figure 10:
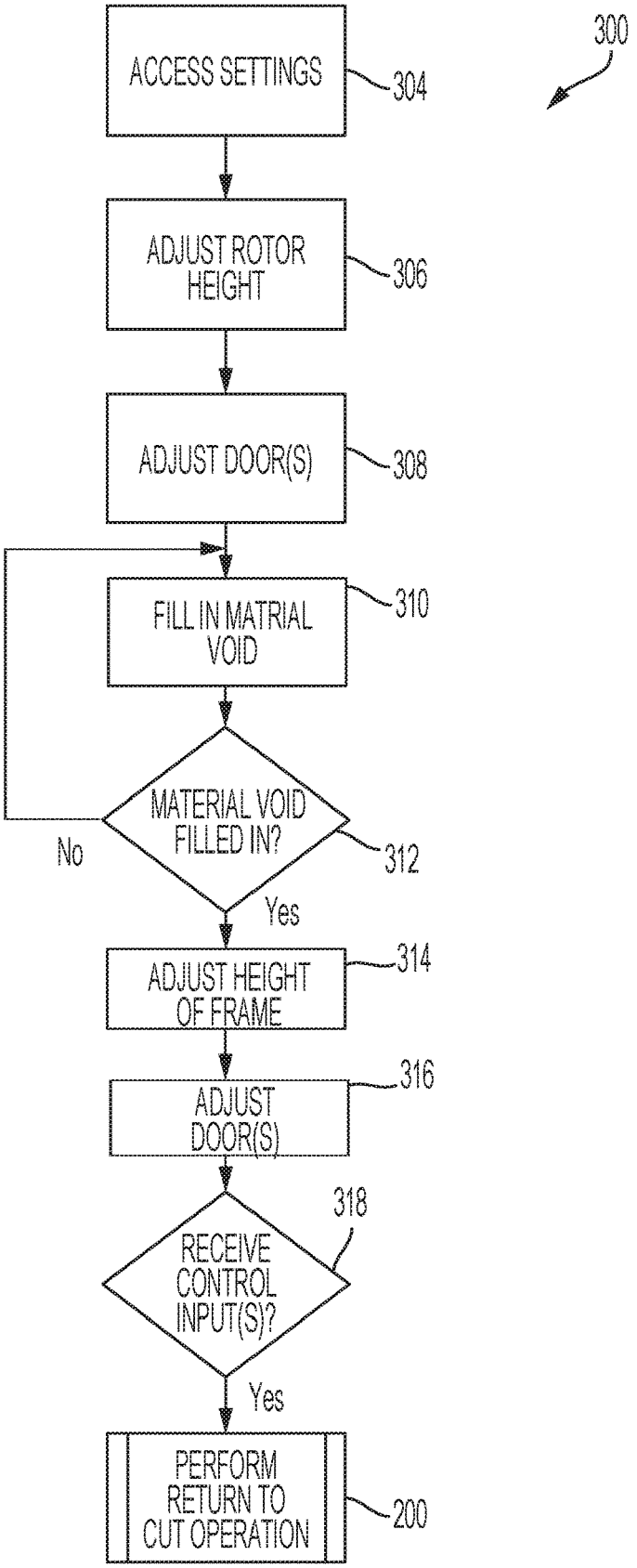
FIG. 10 is a flow chart of a method for an exit cut operation according to one or more embodiments of the disclosed subject matter.

FIG. 10 is a flow chart of a method 300 for an exit cut operation according to one or more embodiments of the disclosed subject matter. As noted above, the controller 152 can control the legs 112, the rotor 116, the front door 124, and the rear door 126 to perform the exit cut operation. And such control can be based on data from one or more sensors, such as data from the image sensor(s) 140 and/or the sonic sensor(s) 142.

The control input(s) to initiate the exit cut operation can be received at an end of a cutting pass of the milling machine 100. Additionally or alternatively, the control input(s) to initiate the exit cut operation can be received during (e.g., in the middle of) the cutting pass of the milling machine 100. Thus, according to embodiments of the disclosed subject matter, the exit cut operation can separate two successive return to cut operations of a same cutting pass, or may separate successive return to cut operations of successive cutting passes of the milling machine 100.

At operation 304 the method 300 can access settings for the milling machine 100 to perform the exit cut operation. As noted above, such settings can be stored in the memory 154 and accessed by the controller 152. In that the exit cut operation can follow a return to cut operation, the exit cut operation may start from settings set for a most recent return to cut operation.

At operation 306 the height of the rotor 118 can be adjusted. For example, the height of the rotor 118 can be raised by controlling one or more actuators thereof (not expressly shown) operatively coupled to the rotor 118. Such adjustment can be relative to the ground, and can be from a cutting height for the rotor 118 toward a stow or travel height, such as shown in FIG. 6. The height of the rotor 118 can be adjusted independent of the adjustment of the frame 102. The adjustment of the height of the rotor 118 can be based on signals from a position sensor associated with the rotor 118, such as a position sensor of the corresponding actuator. Optionally, the adjustment of the height of the rotor 118 can be based on processing of data from one or more of the image sensors 140.

According to one or more embodiments, the rate at which the rotor 118 is raised can be based on the speed of travel of the milling machine 100. For instance, the rate at which the rotor 118 is raised can be proportional to the speed of travel of the milling machine 100, meaning, generally speaking, that the faster the milling machine 100 is traveling during the exit cut operation the faster the rotor 118 can be raised. Moreover, the rate at which the rotor 118 is raised may be linear or non-linear. Optionally, the rate at which the rotor 118 is raised can vary depending upon the height of the rotor 118 and/or a cutting depth of the rotor relative to the surface layer 400. For instance, the rate at which the rotor 118 is raised can increase as the rotor 118 is raised. Optionally, the height at which the rotor 118 is raised can be at a maximum rate when the rotor 118 reaches the top surface of the surface layer 400 (or determined or estimated to have reached the top surface) or increased to the maximum rate when the bottom of the rotor 118 (or some other portion thereof) is determined to have reached the top surface of the surface layer 400.

At operation 308 the front door 124 and/or the rear door 126 can be adjusted. Optionally, the front door 124 and/or the rear door 126 can be adjusted as the rotor 118 is being raised. Moreover, adjustment of the front door 124 and/or the rear door 126 can be from respective states set during the preceding return to cut operation or cutting operation and, furthermore, can be based on the direction of travel of the milling machine 100. Thus, the front door 124 and the rear door 126 may be adjusted from respective open positions (though not necessarily open by the same amount).

The adjustment of the front door 124 and/or the rear door 126 of operation 308 may be to fill in a material void 402 that may be caused, created, or left by the raising of the rotor 118. As noted above, the adjustment of the front door 124 and/or the rear door 126 may be based on the direction of travel of the milling machine 100. For instance, when the milling machine 100 is moving forward the front door 124 can be controlled to remain open or open more and the rear door 126 can be set to the floating state (if not already in the floating state) or to close by a certain amount (e.g., but not entirely closed). Thus, the rear door 126 can be used to fill in the material void 402 when the milling machine 100 is moving forward. And when the milling machine 100 is moving backward the rear door 126 can be controlled to remain open or open more and the front door 124 can be set to the floating state or to close by a certain amount (e.g., but not entirely closed). Thus, the front door 124 can be used to fill in the material void 402 when the milling machine 100 is moving backward. As noted above, in the floating state the floating door, whether the front door 124 or the rear door 126, can provide a down pressure. In the case of the rear door 126, such down pressure may be different from the down pressure set for the return to cut operation.

The adjustment of the front door 124 and/or the rear door 126 can be based on signals from one or more of the image sensors 140 and/or one or more of the sonic sensors 142. For instance, data from the image sensor(s) 140 and/or the sonic sensor(s) 142, particularly those at the front and rear of the mixing chamber 116, can be processed, using the controller 152, to determine positioning of the front door 124 and/or the rear door 126 (e.g., open, closed, amount open, moving, etc.). The processing can also involve determining when the front door 124 and/or the rear door 126 have reached the desired state.

Operation 310 can represent a process of filling in the material void 402. Such operation 310 can be performed based on the settings of the front door 124 and the rear door 126, as well as based on the speed of travel of the milling machine 100 and the rate at which the rotor 118 is raised. Generally, filling in the material void 402 can involve whichever of the front door 124 or the rear door 126 is to fill in the material void 402, depending upon the direction of travel of the milling machine 100, can direct the resultant material 406 so as to fill in the material void 402 as the milling machine 100 moves in the forward or backward direction of travel as the case may be.

At operation 312 the method 300 can include determining whether the material void 402 has been satisfactorily filled in. Such determination can be based on data from one or more of the image sensors 140 and/or one or more of the sonic sensors 142. For instance, such data may be processed automatically using the controller 152 to determine whether the material void 402 has been satisfactorily filled in.

As but one example, the image sensor(s) 140 may be used to capture data corresponding to the start of an exit cut and the current position of the milling machine 100, where such data can be used by the controller 152 to calculate a distance travelled since the start of the exit cut operation. Based on the settings of the milling machine 100 a certain distance may be indicative that the material void 402 has been filled in. Thus, determination that the milling machine 100 has traveled a certain distance may be used as an indication that the material void 402 has been filled in.

According to another example, image data from the image sensor(s) 140 at the front and/or rear of the mixing chamber 116, depending upon the direction and distance of travel, can be processed using the controller 152 to determine whether the material void 402 has been filled in. Optionally, such determining can be based on machine learning and training using images of suitably filled in material voids 402. Likewise, the sonic sensor(s) 142 at the front of the mixing chamber 116 and/or at the rear of the mixing chamber 116 may be representative of whether the material void 402 has been filled in and may be processed using the controller 152 to determine whether and when the material void 402 has been filled in.

Optionally, image data from the image sensor(s) 140, for instance an image sensor 140 at the rear side of the mixing chamber 116, may be provided to the operator, via one or more displays of the operator control interface 134, for the operator to visually determine whether the material void 402 has been satisfactorily filled in.

At operation 314 the height of the frame 102 can be adjusted. Though FIG. 10 shows that the height of the frame 102 can be adjusted after the operation 312 to determine whether the material void 402 is filled in, optionally, the height of the frame 102 may begin being adjusted before the final determination that the material void 402 has been filled in, though typically a predetermined amount of time after the initiation of the operation 310 to fill in the material void 402.

The height of the frame 102 can be raised by controlling one or more of the legs 112, such as all of the legs 112. Such height adjustment can be relative to the ground surface, and can be to a travel or non-cutting height. Such adjustment can also adjust (e.g., raise) the height of the rotor 118. The adjustment of the height of the frame 102 can be based on signals from one or more of the image sensors 140 and/or one or more of the sonic sensors 142. For instance, data from the image sensor(s) 140 and/or the sonic sensor(s) 142 can be processed to determine height of the frame 102 relative to the ground surface and/or height of the mixing chamber 116 relative to the ground surface. In that the front door 124 and the rear door 126 can be operatively coupled to the mixing chamber 116, the rate at which the frame 102 (and hence the mixing chamber 116) is raised can determine how the material void 402 gets filled in (e.g., how quickly, how much, patterning, etc.). Optionally, the rate at which the frame 102 is raised can be steady or linear, which may better ensure that the material void 402 is filled in with material having a suitable surface (e.g., grade, uniformity, etc.).

At operation 316 the front door 124 and/or the rear door 126 can be adjusted, particularly in a case where the operation 210 and 212 were performed to fill in the material void 402. Such adjustment may be to a travel or stow position, which may be fully or partially closed. Though operation 316 is shown after operation 314, operation 316 may start during operation 314, for instance, at the same time at which operation 314 starts or after a predetermined amount of time after operation 314 starts.

At operation 318 the method 300 may determine whether another control input is received, such as a control input to perform the return to cut operation of method 200. If another control input is received to perform the return to cut operation the method 300 can proceed to method 200, otherwise the exit cut operation can end.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

The invention claimed is:

1. A milling machine comprising:

an operator control interface;

a frame;

a milling chamber having a front door, a rear door opposite the front door, and a pair of opposing side plates between the front door and the rear door;

a rotor provided at least partially in the milling chamber;

a plurality of sensors provided about the frame, one or more of the plurality of sensors being image sensors; and a controller configured to control a plurality of legs of the milling machine, the rotor, the front door, and the rear door according to settings stored in memory accessible by the controller for each of an automated return to cut operation and an automated exit cut operation, wherein for the automated return to cut operation the controller controls the plurality of legs of the milling machine, the rotor, the front door, and the rear door according to a first plurality of settings to return to first previously set operator settings corresponding to an immediately previous cutting operation to perform a next cutting operation, wherein for the automated exit cut operation the controller controls the plurality of legs of the milling machine, the rotor, the front door, and the rear door according to a second plurality of settings to exit a current cutting operation according to second previously set operator settings, and wherein the controller is configured to control each of the automated return to cut operation and the automated exit cut operation responsive to respective single control inputs at the operator control interface and based on signals from the plurality of sensors, including based on the signals from the one or more image sensors.

2. The milling machine according to claim 1, wherein the plurality of sensors further includes at least one of a plurality of sonic sensors and a plurality of laser sensors.

3. The milling machine according to claim 1, wherein the plurality of sensors includes the one or more image sensors to sense a height of one or more of the side plates, at least one sensor to sense a height of the frame, and at least one sensor to sense a height of one or more of the legs of the milling machine, the at least one sensor to sense the height of the one or more legs of the milling machine being external to the one or more legs of the milling machine.

4. The milling machine according to claim 1, wherein the control according to the first plurality of settings for the automated return to cut operation includes:

adjusting a height of the frame relative to ground to a cutting height using the signals from the sensors, lowering the rotor, independent of the frame, to a rotor cutting height, moving the front door to a front door cutting position, the front door being at least partially open in the front door cutting position, and moving the rear door to a rear door cutting position, the rear door being at least partially open and in a locked state or a floating state in the rear door cutting position, wherein in the locked state the rear door is open by an amount set according to the first plurality of settings, and wherein in the floating state the rear door provides a down pressure set according to the first plurality of settings.

5. The milling machine according to claim 1, wherein the control according to the second plurality of settings for the automated exit cut operation includes:

raising the rotor to a stowed or travel position, and as the rotor is being raised to the stowed or travel position, adjusting positioning of the front door and the rear door, based on direction of travel of the milling machine, to fill in a material void caused by the raising rotor, wherein when the milling machine is moving forward the front door is caused to open and the rear door is set to a floating state, and when the milling machine is moving backward the rear door is caused to open and the front door is set to the floating state, and wherein in the floating state the rear door or the front door provides a down pressure.

6. The milling machine according to claim 5, wherein the one or more image sensors include a plurality of image sensors in the form of cameras, a first camera of the plurality of cameras being configured to record images at the front door and a second camera of the plurality of cameras being configured to record images at the rear door, and wherein the controller processes signals from one or both of the first camera and the second camera to determine whether the material void has been filled in.

7. The milling machine according to claim 5, wherein the plurality of sensors include a plurality of sonic sensors, a first sonic sensor of the plurality of sonic sensors being configured to sense material height at the front door and a second sonic sensor of the plurality of sonic sensors being configured to sense material height at the rear door, and wherein the controller processes signals from one or both of the first sonic sensor and the second sonic sensor to determine whether the material void has been filled in.

8. The milling machine according to claim 5, wherein the control according to the second plurality of settings for the automated exit cut operation includes raising the legs of the milling machine to a travel position as the material void is being filled in and based on a speed of the milling machine, and wherein a rate of raising the legs is directly proportional to the speed of the milling machine.

9. The milling machine according to claim 1, wherein the immediately previous cutting operation and the next cutting operation are part of a same pass of the milling machine.

10. The milling machine according to claim 1, wherein the controller is configured to control each of the automated return to cut operation and the automated exit cut operation responsive to the respective single control inputs at the operator control interface and based on the signals from the plurality of sensors, including based on the signals from the one or more image sensors, without processing sensor data from position sensors in the plurality of legs of the milling machine or without the plurality of legs of the milling machine having any position sensors.

11. A milling machine comprising:

an operator control interface;

a milling chamber having a front door, a rear door opposite the front door, and a pair of opposing side plates between the front door and the rear door;

a rotor provided at least partially in the milling chamber;

a plurality of sensors, one or more of the plurality of sensors being cameras; and a controller configured to control a plurality of legs of the milling machine, the rotor, the front door, and the rear door according to settings stored in memory accessible by the controller for each of an automated return to cut operation and an automated exit cut operation, wherein for the automated return to cut operation the controller controls the plurality of legs of the milling machine, the rotor, the front door, and the rear door according to a first plurality of settings to return to first previously set operator settings corresponding to an immediately previous cutting operation to perform a next cutting operation, wherein for the automated exit cut operation the controller controls the plurality of legs of the milling machine, the rotor, the front door, and the rear door according to a second plurality of settings to exit a current cutting operation according to second previously set operator settings, and wherein the controller is configured to control each of the automated return to cut operation and the automated exit cut operation responsive to respective single control inputs at the operator control interface and based on signals from the plurality of sensors, including based on the signals from the one or more cameras.

12. The milling machine according to claim 11, wherein the controller is configured to control each of the automated return to cut operation and the automated exit cut operation responsive to the respective single control inputs at the operator control interface and based on the signals from the plurality of sensors, including based on the signals from the one or more cameras, without processing sensor data from position sensors in the plurality of legs of the milling machine.

13. The milling machine according to claim 11, wherein the controller is configured to control each of the automated return to cut operation and the automated exit cut operation responsive to the respective single control inputs at the operator control interface and based on the signals from the plurality of sensors, including based on the signals from the one or more cameras, without the plurality of legs of the milling machine having any position sensors.

14. The milling machine according to claim 11, wherein the automated return to cut operation includes:

responsive to the single control input at the operator control interface, automatically lowering, under control of the controller, a frame of the milling machine to a cutting height, responsive to the single operator control input at the operator control input, automatically lowering, under control of the controller, the rotor of the milling machine to a rotor cutting height independent of the automatic lowering of the frame, and responsive to the single operator control input at the operator control interface, automatically moving, under control of the controller, a rear door of the milling chamber of the milling machine to a rear door cutting position, the rear door being at least partially open and in a locked state or a floating state in the rear door cutting position, wherein in the locked state the rear door is open by an amount set in advance, and wherein in the floating state the rear door provides a down pressure set in advance.

15. The milling machine according to claim 11, wherein the automated exit cut operation includes:

controlling, using the controller, raising the rotor of the milling machine toward a stowed or travel position as part of the automated exit cut operation, and as the rotor is being raised toward the stowed or travel position, controlling, using the controller, configuration of respective states of a front door and a rear door of the milling chamber of the milling machine, based on direction of travel of the milling machine, to fill in a material void associated with said raising the rotor, as part of the automated exit cut operation, wherein when the milling machine is moving forward the front door is controlled to be open and the rear door is set to a floating state, and when the milling machine is moving backward the rear door is controlled to be open and the front door is set to the floating state, wherein in the floating state the rear door or the front door provides a down pressure set in advance.

16. A machine comprising:

an operator control interface;

a chamber having a front door, a rear door opposite the front door, and a pair of opposing side plates between the front door and the rear door;

a rotor provided at least partially in the chamber;

a plurality of sensors provided about the frame, one or more of the plurality of sensors being image sensors; and a controller configured to control a plurality of legs of the machine, the rotor, the front door, and the rear door according to settings stored in memory accessible by the controller for each of an automated return to cut operation and an automated exit cut operation, wherein for the automated return to cut operation the controller controls the plurality of legs of the machine, the rotor, the front door, and the rear door according to a first plurality of settings to return to first previously set operator settings corresponding to an immediately previous cutting operation to perform a next cutting operation, wherein for the automated exit cut operation the controller controls the plurality of legs of the machine, the rotor, the front door, and the rear door according to a second plurality of settings to exit a current cutting operation according to second previously set operator settings, and wherein the controller is configured to control each of the automated return to cut operation and the automated exit cut operation responsive to respective single control inputs at the operator control interface and based on signals from the plurality of sensors, including based on the signals from the one or more image sensors, without processing sensor data from position sensors in the plurality of legs of the machine or without the plurality of legs of the machine having any position sensors.

17. The machine according to claim 16, wherein the automated return to cut operation includes:

responsive to the single control input at the operator control interface, automatically lowering, under control of the controller, a frame of the machine to a cutting height, responsive to the single operator control input at the operator control input, automatically lowering, under control of the controller, the rotor of the machine to a rotor cutting height independent of the automatic lowering of the frame, and responsive to the single operator control input at the operator control interface, automatically moving, under control of the controller, the rear door of the chamber of the machine to a rear door cutting position, the rear door being at least partially open and in a locked state or a floating state in the rear door cutting position, wherein in the locked state the rear door is open by an amount set in advance, and wherein in the floating state the rear door provides a down pressure set in advance.

18. The machine according to claim 16, wherein the automated exit cut operation includes:

controlling, using the controller, raising the rotor of the machine toward a stowed or travel position as part of the automated exit cut operation, and as the rotor is being raised toward the stowed or travel position, controlling, using the controller, configuration of respective states of the front door and the rear door of the chamber of the machine, based on direction of travel of the machine, to fill in a material void associated with said raising the rotor, as part of the automated exit cut operation, wherein when the machine is moving forward the front door is controlled to be open and the rear door is set to a floating state, and when the machine is moving backward the rear door is controlled to be open and the front door is set to the floating state, wherein in the floating state the rear door or the front door provides a down pressure set in advance.

* * * * *